US011745519B2

(12) United States Patent
Canales et al.

(10) Patent No.: US 11,745,519 B2
(45) Date of Patent: Sep. 5, 2023

(54) DIRECT HEAT VACUUM PLATEN

(71) Applicant: Creators Equity LLC, Cheyenne, WY (US)

(72) Inventors: Said Canales, Irvine, CA (US); Victor Pena, Irvine, CA (US)

( * ) Notice: Subject to any disclaimer, the term of this patent is extended or adjusted under 35 U.S.C. 154(b) by 2 days.

(21) Appl. No.: 17/452,328

(22) Filed: Oct. 26, 2021

(65) Prior Publication Data

US 2023/0126334 A1 Apr. 27, 2023

(51) Int. Cl.
*B41J 11/02* (2006.01)
*B41J 11/00* (2006.01)

(52) U.S. Cl.
CPC ..... *B41J 11/0085* (2013.01); *B41J 11/007* (2013.01); *B41J 11/0024* (2021.01)

(58) Field of Classification Search
CPC ..... B41J 11/00242
See application file for complete search history.

(56) References Cited

U.S. PATENT DOCUMENTS 6,454,478 B2 9/2002 Wotton et al.
2009/0251522 A1* 10/2009 Koike ..... B41J 11/007 347/104
2012/0013670 A1* 1/2012 Toya ..... B41J 2/16517 347/16

FOREIGN PATENT DOCUMENTS

JP 2004338175 A * 12/2004
JP 2009066864 A * 4/2009
WO WO-2015050069 A1 * 4/2015 ..... B41J 11/002

OTHER PUBLICATIONS

English language machine translation of JP 2004-338175 A, publication date Dec. 2, 2004. (Year: 2004).*
English language machine translation of JP 2009-066864 A, publication date Apr. 2, 2009. (Year: 2009).*
English language machine translation of WO 2015050069 A1, publication date Apr. 9, 2015. (Year: 2015).*

* cited by examiner

*Primary Examiner* — Leslie J Evanisko
(74) *Attorney, Agent, or Firm* — Marin Cionca; CIONCA IP Law P.C.

(57) ABSTRACT

A direct heat vacuum platen having a main case with an open top portion, a print surface having a main top configured to fit over the open top portion of the main case, the main top having a rectangular arrangement of suction ports configured to secure an above print substrate using suction provided from vacuum fans attached to the main case, heating elements attached to a bottom portion of the main top, a thermoregulator having a thermostat controller attached to temperature sensors and the heating elements within the main case, and a power controller having a power slot attached to a power switch and main fuse holder, a fan fuse holder, the thermostat controller and the suction fans. The suction ports are configured to hold a print substrate of a desired size. The usage of the internal vacuum fans reduces noise and power usage when compared to external vacuum apparatuses.

19 Claims, 7 Drawing Sheets

DIRECT HEAT VACUUM PLATEN

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF INVENTION

1. Field of the Invention

The invention relates generally to platens and more specifically to platens for use with printers.

2. Description of the Related Art

There is a challenge in the printing industry to maintain the film or any other print substrate used (e.g., paper) in place when the print substrate is placed on a platen for printing, such that to avoid print registration issues. Another challenge is to control the proper print temperature to be able to dry the ink faster in order to speed up the printing time and control phenomena such as dot gain while still maintaining image resolution and obtaining high quality prints. A common approach used to keep a print substrate in place during printing is through the utilization of an external vacuum pump. This approach has the downside of significantly increasing the complexity, size and noise level of the assembly and potentially requiring cumbersome hoses to be attached between the external vacuum pump and the platen.

Therefore, there is a need to provide a solution to these challenges via an improved platen that can reliably keep the print substrate in place and provide controllably the temperature necessary for fast and high-quality printing.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a direct heat vacuum platen is provided, the direct heat vacuum platen comprising: a main case having: a case body having a solid bottom portion, an open top portion, a pair of opposite long side ends, a short back end and a short front end, the short front end having two fan ports, a cord port, a power connector port and a fuse port; a support wall attached to the solid bottom portion and disposed between the opposite side long ends; a sensor mount attached to the solid bottom portion and disposed between the opposite side long ends; two vacuum fans, one vacuum fan attached to each fan port; a print surface comprising: a main top having a top surface, a bottom surface, a pair of opposite long side portions, a short back portion and a short front portion, a set of three columns of suction ports positioned on each opposite long side portion, one central column of suction ports disposed equidistantly between the two sets of three columns of suction ports, two rows of suction ports positioned on the short back portion and disposed between the two sets of three columns of suction ports, one row of suction ports positioned on the short front portion and disposed between the two sets of three columns of suction ports, wherein the main top is configured to securely attach over the open top portion of the main case to form a platen cavity and wherein an outer perimeter of suction ports defines a rectangular area; a heat transfer panel secured below the main top, the heat transfer panel having two holes and a column of panel suction ports, each suction port of the column of panel suction ports configured to align coaxially with a suction port of the central column of suction ports on the main top and wherein the heat transfer panel is configured to not cover any suction ports; two heat element plates secured below the heat transfer panel, the two heat element plates running parallel with each other and being separated from each other by a fixed gap, each heat element plate having an attached wire terminal block and heat element cap, wherein each heat element cap is configured to fit within one of the two holes on the heat transfer panel, such that the fixed gap between the two heat element plates is maintained and the column of panel suction ports is positioned above the fixed gap and wherein the heat element plates are configured to not cover any suction ports; three heat element brackets configured to attach to the main top by its bottom surface such that the heat transfer panel and heat element plates are secured between the heat element brackets and the main top with the two heat element plates below the heat transfer panel; a thermoregulator having: a thermostat controller; a thermostat cord attached to the thermostat controller and each heat element cap; a cord holder attached to the thermostat cord and attached to the short front end of the main case such that the thermostat cord travels through the cord holder and the cord port in the short front end of the main case; two temperature sensors, each temperature sensor attached to the sensor mount and the thermostat cord; a thermostat power switch connected to the thermostat controller wherein the thermostat power switch is configured to selectively provide power to the heat element plates based upon a platen temperature detected by the temperature sensors; and a power controller having: a power connector attached to the power connector port, the power connector comprising a power slot configured to connect to an external power source, a main fuse holder attached to the power slot and a power switch attached to the power slot wherein the power switch is configured to selectively engage or disengage power draw from the external power source and electrical wiring configured to connect the power connector to the wire terminal blocks, the wire terminal blocks to a fan fuse holder and thermostat cord, the thermostat cord to the heat element caps and the fan fuse holder to the vacuum fans, wherein the fan fuse holder is attached to the fuse port. Thus, an advantage is that the vacuum fans provide an internal vacuum method that does not require external vacuum elements. Another advantage is that the amount of noise created by the vacuum fans may be significantly less than alternative vacuuming mechanisms. Another advantage is that the vacuum fans may require less power to operate than a conventional vacuum pump. Another advantage is that the utilization of a thermoregulator allows for a desired platen temperature to be set to provide a balance of print speed and quality. Another advantage is that a minimal amount of suction ports may be used to provide appropriate suction to secure a print substrate to the printing surface, reducing the complexity of the apparatus, and optimizing the amount of suction provided by each suction port.

In another aspect, a direct heat vacuum platen is provided, the direct heat vacuum platen comprising: a main case having: a case body having a solid bottom portion, an open top portion, a pair of opposite long side ends, a short back end and a short front end, the short front end having two fan ports; a sensor mount attached to the solid bottom portion and disposed between the opposite side long ends; two vacuum fans, one vacuum fan attached to each fan port; a print surface comprising: a main top having a top surface, a bottom surface, a pair of opposite long side portions, a short back portion and a short front portion, a set of three columns of suction ports positioned on each opposite long side portion, one central column of suction ports disposed equidistantly between the two sets of three columns of suction ports, two rows of suction ports positioned on the short back portion and disposed between the two sets of three columns of suction ports, one row of suction ports positioned on the short front portion and disposed between the two sets of three columns of suction ports, wherein the main top is configured to securely attach over the open top portion of the main case to form a platen cavity and wherein an outer perimeter of suction ports defines a rectangular area; two heat element plates secured below the main top, the two heat element plates running parallel with each other and being separated from each other by a fixed gap, each heat element plate having an attached wire terminal block and heat element cap, wherein the central column of suction ports on the main top is positioned above the fixed gap and wherein the heat element plates are configured to not cover any suction ports; a thermoregulator having: a thermostat controller; a thermostat cord attached to the thermostat controller and both heat element caps wherein the thermostat cord travels into the main case through a cord port; two temperature sensors, each temperature sensor attached to the sensor mount and the thermostat controller; a power controller having: a power slot configured to connect to an external power source; a power switch attached to the power slot, the power switch configured to selectively engage or disengage power draw from the external power source and electrical wiring configured to provide power to the thermostat controller, heat element caps and vacuum fans. Again, an advantage is that the vacuum fans provide an internal vacuum method that does not require external vacuum elements. Another advantage is that the amount of noise created by the vacuum fans may be significantly less than alternative vacuuming mechanisms. Another advantage is that the vacuum fans require less power to operate than a conventional vacuum pump. Another advantage is that the utilization of a thermoregulator allows for a desired platen temperature to be set to provide a balance of print speed and quality. Another advantage is that a minimal amount of suction ports may be used to provide appropriate suction to secure a print substrate to the printing surface, reducing the complexity of the apparatus, and optimizing the amount of suction provided by each suction port.

In another aspect, a direct heat vacuum platen is provided, the direct heat vacuum platen comprising: a main case having a case body with a fan port; a vacuum fan attached to the fan port; a print surface comprising: a main top attached to the case body to form a platen cavity, wherein operation of the vacuum fan creates a vacuum within the platen cavity; a plurality of suction ports in the main top arranged in a pattern consistent with a perimeter of a desired print substrate, wherein the vacuum within the platen cavity creates a suction effect at the main top through the plurality of suction ports; a heater attached to the main top, wherein the heater is configured to provide heat to the main top while not covering any suction ports; a thermoregulator having a thermostat controller connected to a temperature sensor and the heater, wherein the thermostat controller is configured to monitor and manipulate a temperature on the direct heat vacuum platen; and a power controller attached to the main case configured to connect an external power source to the thermostat controller and vacuum fan, wherein the direct heat vacuum platen is configured to simultaneously provide suction and heat to a desired print substrate positioned on the printing surface. Again, an advantage is that the vacuum fans provide an internal vacuum method that does not require external vacuum elements. Another advantage is that the amount of noise created by the vacuum fans may be significantly less than alternative vacuuming mechanisms. Another advantage is that the utilization of a thermoregulator allows for a desired platen temperature to be set to provide a balance of print speed and quality. Another advantage is that a minimal amount of suction ports may be used to provide appropriate suction to secure a print substrate to the printing surface, reducing the complexity of the apparatus, and optimizing the amount of suction provided by each suction port.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
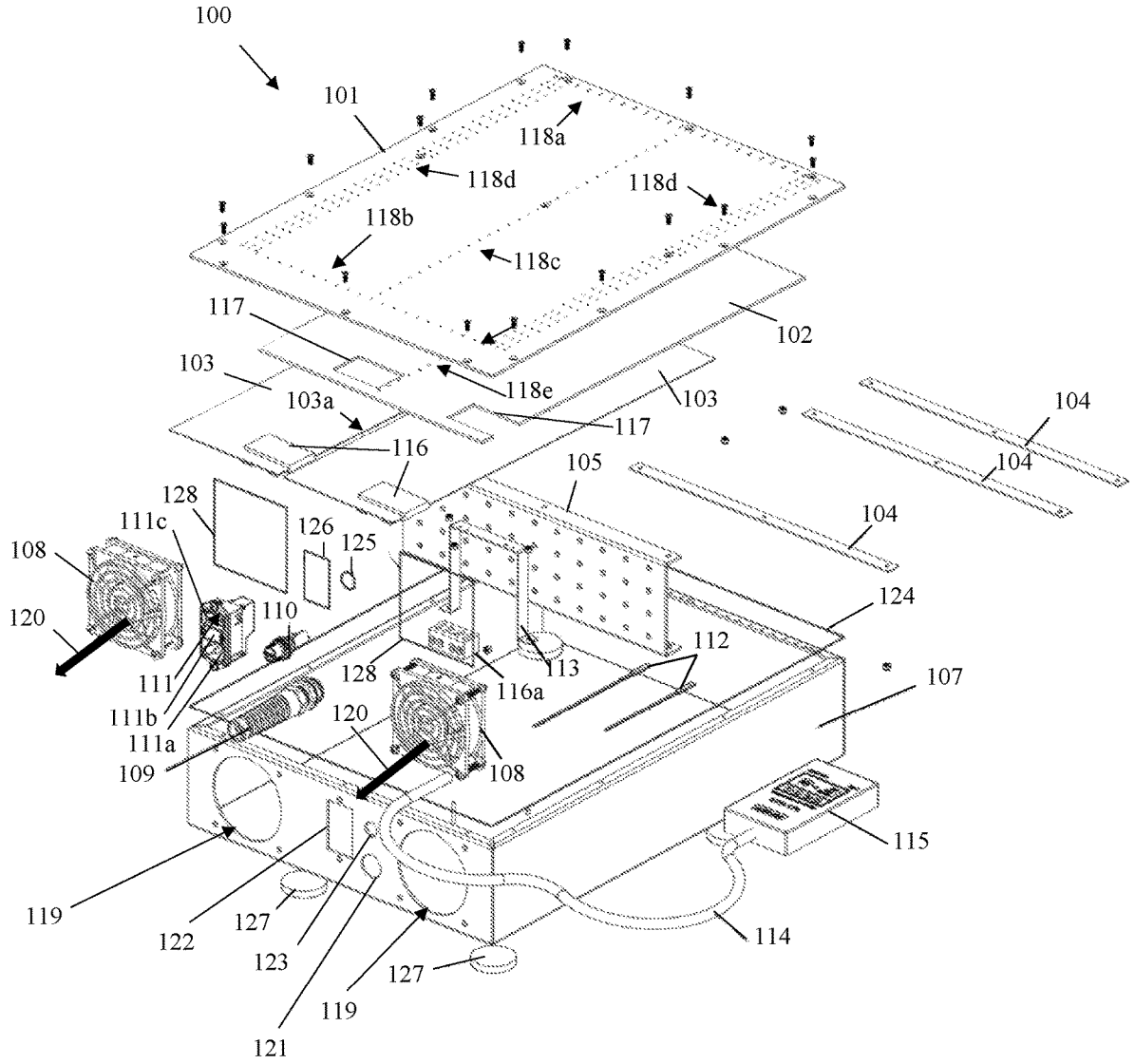
FIG. 1 illustrates an exploded view of a direct heat vacuum platen, according to several aspects.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 105 and 205, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates an exploded view of a direct heat vacuum platen 100, according to several aspects. The direct heat vacuum platen 100 may be comprised of several main elements: a main case 107, two vacuum fans 108, a print surface, a thermoregulator and a power controller. The main case 107 may be described as a rectangular prism that is missing its top face, such that it has a solid bottom portion, and open top portion, a pair of opposite long side ends, a short back end and a short front end. The short front end may house two vacuum fans 108, each in a different vacuum fan port 119. There may also be a support wall 105 designed to provide structure to the platen 100 during operation and a sensor mount 113 configured to hold temperature sensors, both the support wall 105 and the sensor mount 113 disposed between the pair of opposite long side ends and attached to the solid bottom portion of the main case 107.

The print surface may be configured to attach to the open top portion of the main case 107. The print surface may be comprised of a main top 101 having a top surface, a bottom surface, a pair of opposite long side portions, a short back portion and a short front portion. The main top 101 may also house a plurality of suction ports, each suction port positioned based upon the placement of subjacent heating elements. On each opposite long side portion there may be a set of three columns of suction ports 118*d*. Between the two sets of three columns of suction ports 118*d* there may be a central column of suction ports 118*c* placed equidistantly between the two sets, two rows of suction ports 118*a* placed on the short back portion of the main top 101 and one row of suction ports 118*b* placed on the short front portion of the main top 101. An outer perimeter formed by the arrangement or pattern of suction ports may create a rectangular shape. The dimensions of this rectangular shape may be slightly smaller than those of the intended sheets or other print substrate, such that all suction ports are located within the perimeter of the print substrate. The print substrate may be a film, such as with direct to film printing applications, a paper, such as with conventional document printing, a cloth material, or any other suitable printing material.

Figure 3:
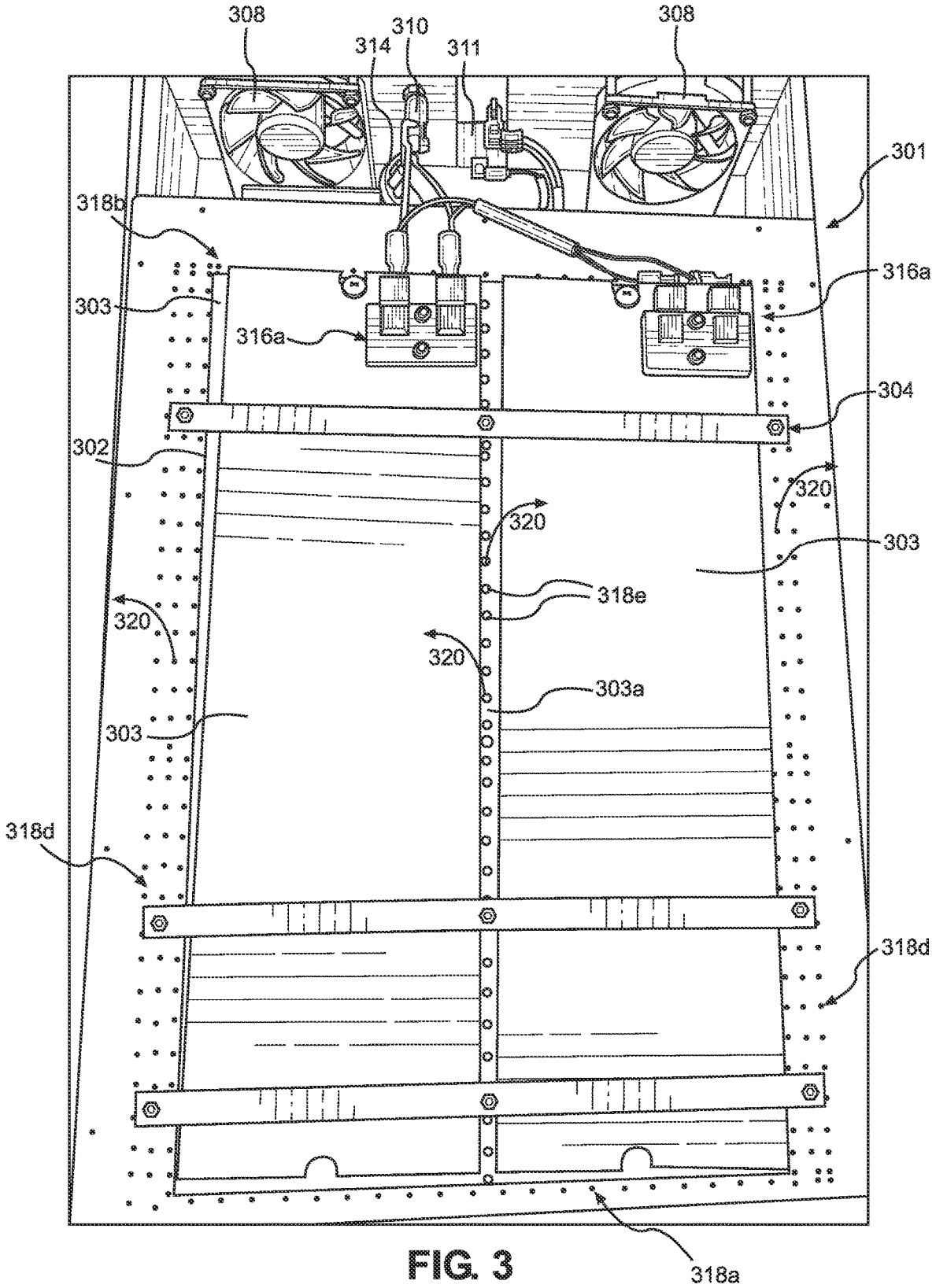
FIG. 3 illustrates a partial top-perspective view of the platen from FIG. 1 when the platen is in a partially assembled state, having the top flipped over for better viewing of some components, according to an aspect.

The print surface may be further comprised of various heating elements, including heat element plates 103 and heat element caps 116, as well as a heat transfer panel 102, one or more wire terminal blocks 116*a* and heat element brackets 104. The elements that create and transfer heat to the main top, such as the heat element plates 103, heat element caps 116 and heat transfer panel 102 may be combined to form a heater that provides the necessary heat to main top, and thus a held print substrate. Secured just below the main top 101 may be the heat transfer panel 102 designed to transfer and evenly distribute heat from the attached heating elements to the main top 101. The heat transfer panel 102 may contain two rectangular holes 117 within it, as well as a column of panel suction ports 118*e*. Each suction port of the column of panel suction ports 118*e* may be configured to align coaxially with a suction port on the central column of suction ports 118*c* on the main top 101. Secured below the heat transfer panel 102 may be two heat element plates 103, each heat element plate 103 having an attached heat element cap 116. A wire terminal block 116*a* may be attached one of the heat element plates 103 as depicted in FIG. 1, both of the heat element plates 103, or a wire terminal block, such as wire terminal block 316*a*, may be attached to each heat element plate 303, for a total of two wire terminal blocks 316*a* as depicted in FIG. 3. The wire terminal block(s) may also be in any other suitable position in which they interconnect the electrical elements of the platen 100 as needed. The heat element caps 116 may be positioned in such a way that they fit within the above rectangular holes 117 in the heat transfer panel 102, resulting in the heat element plates 103 being positioned parallel to each other and separated by a fixed gap 103*a*. This fixed gap 103*a* between the heat element plates 103 may be positioned such that the above coaxially aligned suction ports are not blocked or otherwise impeded. Three heat element brackets 304 may attach to the bottom surface of the main top 101 and may be used to secure the heat transfer panel 102 and heat element plates 103 to the main top 101.

A thermoregulator may be used to properly monitor and adjust the temperature of the print surface. The thermoregulator may be comprised of a thermostat controller 115, a thermostat cord 114 attached to the thermostat controller 115, a cord holder 109 attached to the thermostat cord and attached to the short front end of the main case 107, such that the thermostat cord 114 travels through a cord holder 109 and a cord port 121 in the short front end of the main case, and two temperature sensors 112. The cord holder 109 may be attached to the thermostat cord 114 to provide strain relief to the thermostat cord 114. The thermostat cord 114 may be provided with two distinct portions, an input portion (not shown) configured to transfer power and/or information to the attached thermostat controller 115 and an output portion (not shown) configured to transfer power and/or information from the attached thermostat controller 115. The temperature sensors 112 may be attached to the input portion of the thermostat cord 114 and the sensor mount 113, such that they are not in direct contact with the heating elements. The temperature sensors 112 may also be attached to the thermostat controller 115 without being attached to the thermostat cord 114 through usage of separate wire connections (not shown). The indirect heating of the temperature sensors 112 that occurs when the temperature sensors 112 are not in direct contact with the heating elements may more accurately reflect the temperature of the print surface, instead of a localized portion of a heat element, providing a more accurate temperature reading. The thermostat cord 114, and thus its input and output portions, may attach to the thermostat controller 115 such that the thermostat controller may interact accordingly with its attached elements. The thermostat controller 115 may be configured to receive temperature information from the temperature sensors 112 and adjust the amount of power sent through the output wires of the thermostat cord 114 to the heat element caps 116 for heating the heat element plates 103, either through user inputted temperature parameters or other methods. One of the two temperature sensors 112 may be used for standard temperature moderation, while the second may be used as an emergency power cutoff capable of halting platen heating if a temperature safety limit is exceeded.

The thermostat controller 115 may have a connected thermostat power switch (not shown) configured to selectively provide power from the thermostat controller 115 to heat element plates 103, based upon a platen temperature read by the temperature sensors 112. The thermostat power switch may be either internally or externally connected to the thermostat controller. The thermostat power switch may be disposed between an input portion (not shown) and an output portion (not shown) of the thermostat controller 115, such that said thermostat power switch may selectively turn on or off the flow of power to the heat element plates 103, based upon the set desired platen temperature and the current platen temperature. For example, a thermostat controller 115 may be configured to allow a minimum platen temperature of 40 degrees Celsius and a maximum platen temperature of 45 degrees Celsius during platen 100 operation. In said example, if a temperature sensor 112 detects a platen temperature above 45 degrees Celsius, the thermostat power switch may switch off power flow to the heating elements, thus discontinuing heating to reduce the platen temperature. If the platen temperature drops below 40 degrees Celsius, the thermostat power switch may switch on power flow to the heating elements, reenabling the heating of the heat elements. This process may be repeated, continually heating the platen 100 when the platen temperature is too low and ceasing platen heating when the platen temperature is too high.

A power controller may be included to provide power to the various electrical components of the platen 100. The electronic elements of the herein disclosed platen may be connected as described below, having a power connector 111 comprising a power slot 111*a* attached to a main fuse holder 111*b* and a power switch 111*c*, the power connector 111 being connected to one or more wire terminal blocks 116*a*. Each wire terminal block 116*a* may connect to a fan fuse holder 110 and an input portion of the thermostat cord 114. The fan fuse holder 110 may connect to the vacuum fans 108 in parallel. The input portion of the thermostat cord 114 may connect to the thermostat controller 115, which then connects to an output portion of the thermostat cord 114. The output portion of the thermostat cord 114 may connect to each heat element cap 116 to provide heating to their attached heat element plate 103. Each connection described above may be done by a conductive element, such as a wire. The combination of these conductive elements with the described power connector 111 and fan fuse holder 110, results in the formation of the aforementioned power controller. The power slot 111*a* may be configured to attach to an external power source, such as wall socket providing 120 volts AC, to provide power to the platen 100. The power switch 111*c* may be used to selectively engage and disengage power draw from the external power source. The power connector 111, as well as the described fan fuse holder 110 may be embedded into the short front end of the main case 107 for easy access, with the power connector 111 held within a power connector port 122 and the fan fuse holder 110 held within a fuse port 123. The main fuse holder 111*b* and the fan fuse holder 110 may be configured to hold a 10-amp fuse for use with the entire unit and a 0.5-amp fuse for use with the vacuum fans, respectively.

The disclosed direct heat vacuum platen 100 may implement internal vacuum fans 108 to provide a suctional force through the suction ports in the print surface to hold a desired print substrate in place. These vacuum fans 108 may be configured to create this suctional force within the platen cavity as a result of the propulsion of air 120 out of the platen cavity during operation. The usage of these internal vacuum fans 108 may reduce the overall complexity of the platen 100, by removing the need for external vacuuming mechanisms. Additionally, the vacuum fans 108 may provide only a limited amount of noise, helping to reduce the overall volume level of the device during operation.

Various methods may be employed to interconnect the elements of the disclosed direct heat vacuum platen 100. As depicted within FIG. 1 the attachment of the sensor bracket 113 and the support wall 105 to the main case 107 may be done using screws, but may also be done through welding, or comparable methods. The same attachment method outlined above may be used for connecting the main top 101 to both the main case 107 and the heat element brackets 104, as well as attaching the vacuum fans 108 to the main case 107. The power connector 111 and fan fuse holder 110 may be attached to the main case 107 by being embedded within it, either within the short front end of the main case 107, as described previously, or any other suitable location. As discussed above, all electric elements may be attached accordingly using wires (not shown) or comparable conductive methods. The heating elements such as the heat element plates 103 and heat element caps 116 may be interconnected in a way that is consistent with conventional resistance-based heating apparats used in the industry, or other know heating methods present in the industry. For example, a heat element cap 116 may be provided as an insulator that connects to the thermostat cord and a heat wire resistor that is embedded into a heat element plate 103, allowing for the generation of 500 watts of heat when using a 120-volt power source. The temperature sensors 112 may be attached to the sensor bracket 113 through the usage of clips, welding, insertion into sensor ports (not shown) on the sensor bracket 113, or other comparable methods. Each component, including the housings on electronic elements, may be composed of an appropriate material such as metal, plastic or rubber based on its temperature and durability requirements.

In order to properly seal the platen 100 to help maintain the vacuum force established within the platen cavity, several gaskets may be provided between certain platen elements. A top gasket 124 may be positioned between the main case 107 and the main top 101 in order provide a secure fitting of latter to the former. Additionally, a fuse gasket 125 may be positioned between the fan fuse holder 110 and the main case 107, a power connector gasket 126 may be positioned between the power connector 111 and the main case 107 and a fan gasket 128 may be positioned between each vacuum fan 108 and the main case 107, for a total of two fan gaskets 128 in the disclosed platen 100 of FIG. 1, such that these four gaskets help to further seal the platen cavity. The disclosed gaskets, as well as any other gaskets that may be provided on the disclosed platen 100, may be made of a suitable material, such as silicone, that may be used to properly seal the platen cavity while not becoming damaged or otherwise degraded from the operating temperature of the platen 100.

During printer operation, forces exerted upon a print substrate may result in the movement of a provided platen 100 that is holding said print substrate. In order to prevent the disclosed platen 100 from being move during printing, a plurality of anti-slip pads 127 may be attached to the main case 107 or another suitable platen 100 element. An anti-slip pad 127 may be placed on each corner of the solid bottom portion of the main case 107, for a total of four anti-slip pads 127. The anti-slip pads 127 may be made of an appropriate material, such as rubber, to grip the surface that the platen 100 is placed upon, while simultaneously being able to withstand the heat provided by the platen 100. Depending on the shape and size of the platen 100, the positioning and quantity of the provided anti-slip pads 127 may be varied accordingly.

Figure 2:
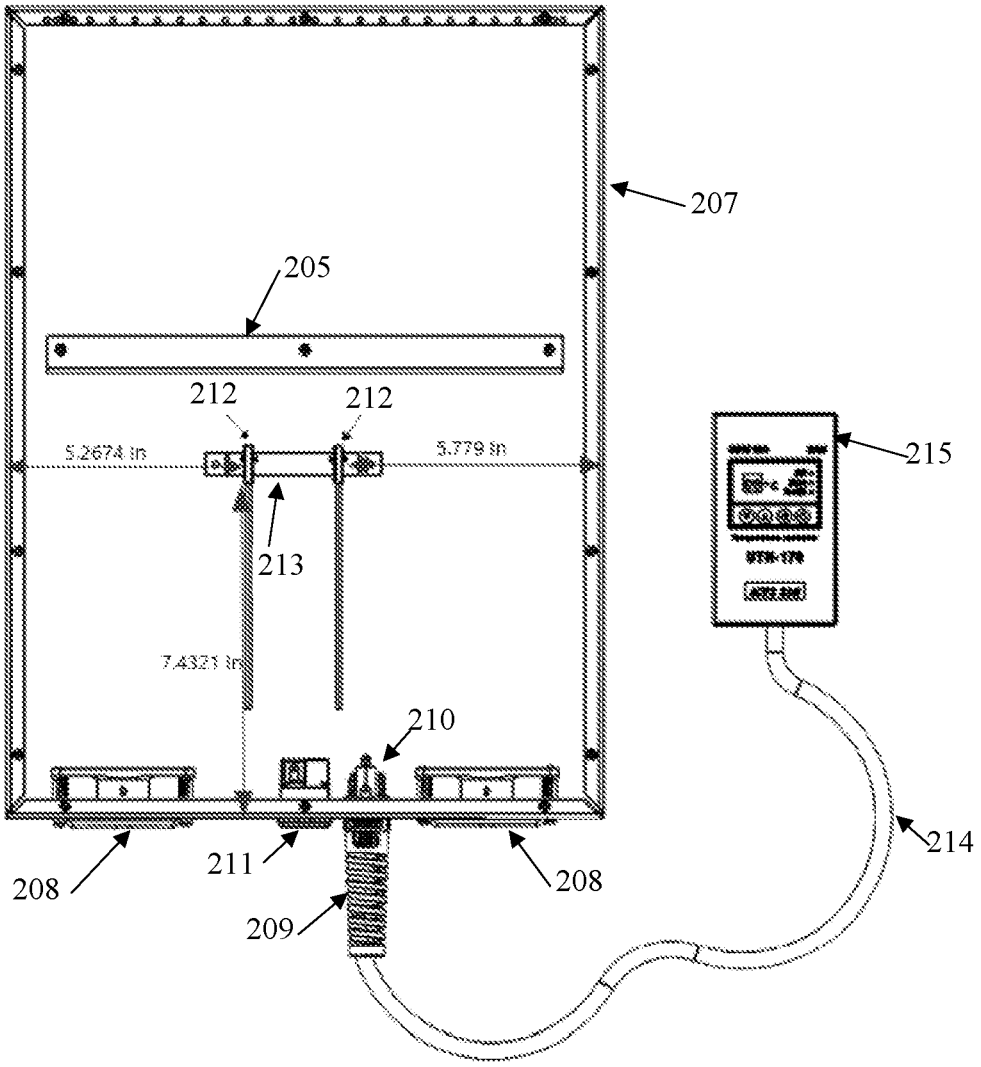
FIG. 2 illustrates the placement of a portion of the components of a direct heat vacuum platen from a top view perspective, according to an aspect.

FIG. 2 illustrates the placement of some of the components from FIG. 1 from a top view perspective, according to an aspect. Some elements visible in this view include, but are not limited to, the vacuum fan 208, support wall 205, cord holder 209, fan fuse holder 210, power connector 211, and sensor mount 213. A thermoregulator or temperature control system may be used in the direct heat vacuum platen to properly moderate the print surface temperature during operation. The thermoregulator may include two temperature sensors 212 within the main case 207 attached to a thermostat controller 215 by a thermostat cord 214. While not shown in FIG. 2, the two temperature sensors 212 may be attached to the thermostat cord 214 or directly to the thermostat controller 215 using wires (not shown) or similar conductive means to allow the temperature sensors to electronically interface with the thermostat controller 215. The spacing of the temperature sensors 212 within the main case 207 may be done as depicted in FIG. 2, having both sensors placed about 7.4321 inches from the shorter end of the main case 207 that holds the thermostat cord 214, with one temperature sensor 212 positioned about 5.779 inches from one longer side of the main case 207, and the other temperature sensor 212 positioned about 5.2674 inches from the opposite longer side of the main case 207. This spacing example is provided purely to describe a potential spacing arrangement for the temperature sensors, and may be modified as needed, so long as device functionality is properly maintained. Both temperature sensors 212 may be present within the platen such that they are not in direct contact with the heating elements. One temperature sensor 212 may be utilized for standard platen temperature control, allowing the user to set a desired temperature setting for the device in order to achieve a desired balance of print speed and print quality, while the other temperature sensor may be present in order to provide overheating protection by halting device operation if a particular temperature safety limit is exceeded. For example, one of the temperature sensors may be configured to have a temperature safety limit of 60 degrees Celsius and will halt power flow to the heating elements or whole platen if it detects a temperature of 60 degrees Celsius or higher in order to prevent damage to the platen, the attached printer and/or the print substrate during operation. By providing these temperature sensors 212 in a manner that is not in direct contact with the heating elements, these sensors 212 may more accurately provide information regarding internal platen temperature at thermal equilibrium during device operation, rather than uneven heating conditions that may occur during device start-up.

FIG. 3 illustrates a partial top-perspective view of the platen from FIG. 1 when the platen is in a partially assembled state, having the top flipped over for better viewing of some components, according to an aspect. Some elements visible in this view include, but are not limited to, the vacuum fan 308, fan fuse holder 310, power connector 311, thermostat cord 314, suction ports 318*a* and suction ports 318*d*. The confinement of the heat element plates 303 and heat transfer panel 302 between the main top 301 and heat element brackets 304 as described in FIG. 1, can be seen from an alternate angle in FIG. 3. As can be seen from this provided view of the platen, the wire terminal block 316*a* may be provided as two separate units, unlike the one depicted in FIG. 1. Each of the two wire terminal blocks 316*a* may be attached to a different heat element plate 303, as depicted in FIG. 3. Such a two wire terminal block 316*a* arrangement may be desirable if independent temperature control of each heat element plate is desired, or a less bulky wiring arrangement is desired that may be facilitated by the splitting of the wire terminal block 316*a* as described. The fixed gap 303*a* present between the two heat element plates 303 allows for a column of panel suction ports 318*e* on the heat transfer panel 302 to allow a suction force present within the platen cavity to be exerted upon an overlying print substrate, as a result of each aforementioned panel suction port 318*e* being coaxially aligned with another suction port from the central column of suction ports 118*c* on the main top 101 as seen in FIG. 1. These centrally paired column suction holes help to provide a sufficient suction contact area between the provided print substrate and the platen, while minimizing the amount of suction holes required to do so. Instead of providing suction holes over the entire area of the print substrate, the herein disclosed platen design provides suction that contacts the perimeter of the print substrate and as well as a line down the center of the print substrate. By providing fewer suction holes, the resultant suction generated by vacuum fan operation is split between fewer sources, resulting in a greater suctional force being applied to each suction port. This may allow for sufficient suction to be provided in order to keep the print substrate stationary during printing, while reducing the total suctional force needed, by only holding the print substrate from critical locations, such as the print substrate perimeter and middle. Because heat is transferred more effectively over a solid medium, the lack of suction ports placed directly over the heat element plates 303 may help to provide a more uniform heating surface on the main top 301 for the print substrate, thus providing a more uniform print quality and print speed throughout the print substrate.

The arrangement of the suction ports on the main top 301 forms a bisected rectangle, such that the solid portions of the main top 301 without suction ports within the formed rectangle correspond to the shape of the heat element plates 303 secured below. While this method may provide a suitable amount of suctional force to secure a print substrate during operation, the arrangement of suction ports may also be modified, as long as they sufficiently correspond to the desired print substrate to be held (e.g., paper, film, cloth, etc.) while not being blocked by the below heating element. In order to facilitate the flow of air 320 to create a suctional force to secure a print substrate, one may modify the heat element plate 303, heat transfer panel 302 and/or the main top 301. In one example, a singular heat element plate may be provided instead of two separate ones. This heat element plate 303 may have suction ports coaxially positioned with those of the heat transfer panel 302, in order to allow a formed vacuum within the platen cavity to immobilize the print substrate. Alternatively, the heat transfer panel 302 may be removed, resulting in the heat element plates 303 contacting the main top 301 directly. In an additional embodiment, there may only be a singular rectangular heat transfer element having a plurality of suction ports that align coaxially with suction ports on the main top 301. Alternative embodiments may be arranged that maintain device functionality by providing appropriately placed gaps or suction holes in locations that align coaxially with other suction holes on elements above and below. Additionally, the amount of suction ports on the main top 301, their diameters, and the way that they are arranged may also be modified, as long as said suction ports allow a vacuum force within the platen 300 to immobilize the desired print substrate.

By adapting the main top 301 and heat transfer panel 302 for use with the disclosed heat element plates 303 and heat element caps (not shown), the assembly may take full advantage of the benefits afforded by said heating elements. The disclosed heat element plates 303 and heat element caps are both light weight, which helps to keep the total weight of the disclosed platen low, allowing for easier transport of the platen and reducing the weight exerted on any printer it is placed in. Additionally, these disclosed heat transfer elements are both economical, allowing for the overall cost of the disclosed direct heat vacuum platen to be minimized, while still providing the desired heating conditions to a held print substrate. Based on the desired heating elements used within the platen assembly, modification to suction hole placements and characteristics may be made accordingly.

Figure 4:
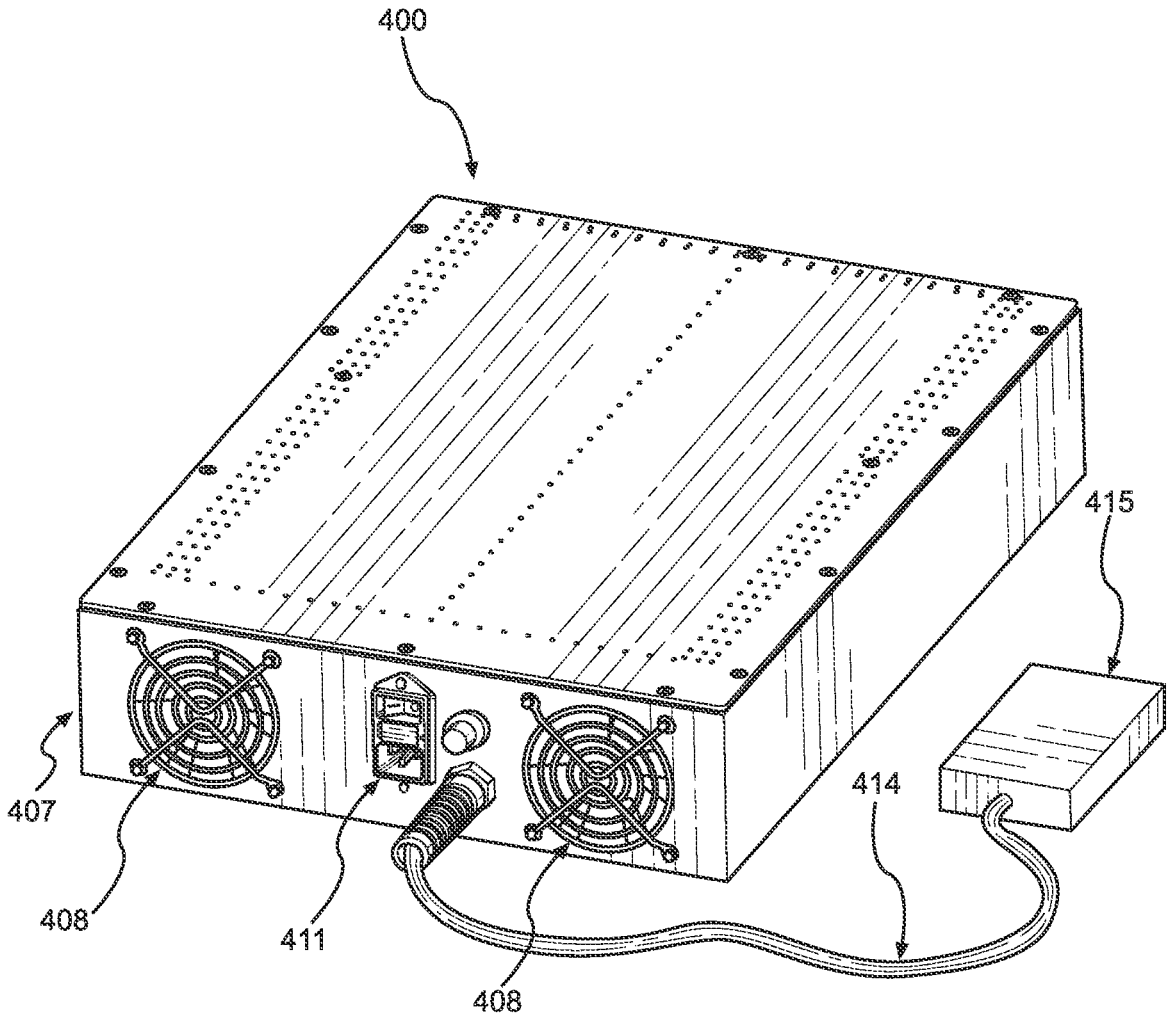
FIG. 4 illustrates a top-perspective view of the platen from FIG. 1, in a fully assembled state, according to an aspect.

FIG. 4 illustrates a top-perspective view of the platen 400 from FIG. 1, in a fully assembled state, according to an aspect. The power connector 411 is visible in this view. The thermostat controller 415 may be attached to the main case 407 by a thermostat cord 414, which in turn connects all temperature control elements to the thermostat controller 415. The thermostat controller 415 may manipulate the heating elements present based on information measured by the temperature sensors (not shown) within the platen, in order to set a desired platen temperature for the held print substrate during printing. In determining the desired operational temperature, certain factors may need to be considered. Using certain higher temperature conditions may allow for the rapid drying of an ink on the print substrate but may compromise print quality. Alternatively, using certain lower temperatures may provide a higher quality print, at the expense of taking longer to dry. Therefore, the desired platen operational temperature must be set to obtain the proper balance of drying speed and printing quality, which may vary depending on the ink, toner or other printing material used, and the print substrate it is applied to. For example, when printing with Omniprint Gamut, a water-based pigment ink, using PET (polyethylene terephthalate) film as a print substrate, an optimal temperature range of between 40 degrees Celsius and 45 degrees Celsius was determined to provide the ideal balance of drying speed and printing quality for the herein disclosed direct heating vacuum platen 400.

Depending on the application of the direct heat vacuum platen 400, various elements and components may be varied or omitted. Alternative embodiments may use only a singular vacuum fan 408 within a singular fan port, a singular temperature sensor, and/or provide the main case 407 and main top in various shapes. Different print substrates may also necessitate different arrangements of suction ports. The arrangement of suction ports may also form different shapes to be consistent with different shapes of print substrates, such as having a circular arrangement of suction ports with a column of suction ports bisecting it down the middle, in order to properly secure a circular substrate to the direct heat vacuum platen 400 during operation. The diameter of each suction port may be 1.7 mm, as they are in FIG. 1-FIG. 6, but may also be varied to be larger or smaller depending on the requirements of the application.

Figure 5:
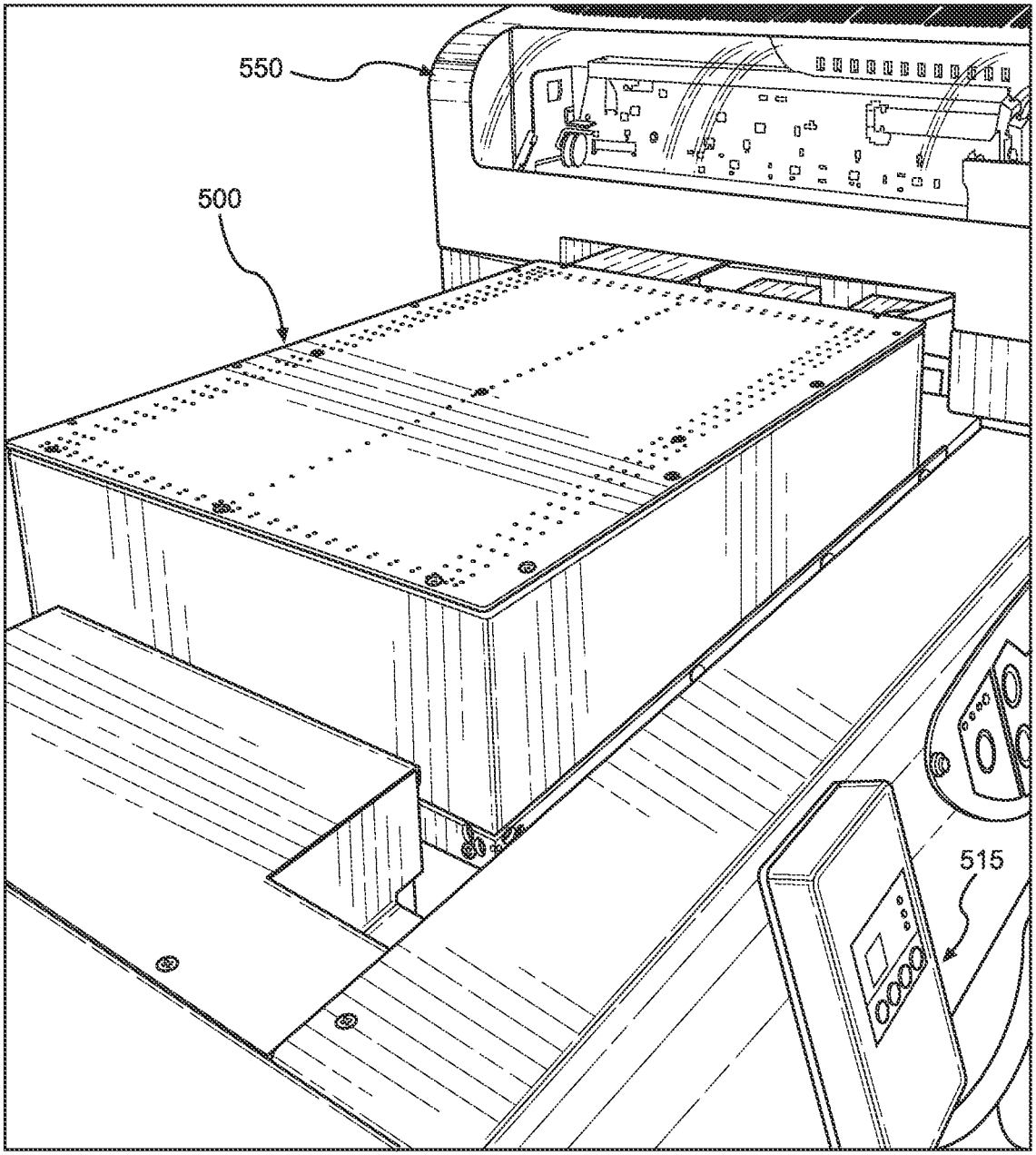
FIG. 5 illustrates a top-perspective view of the platen from FIG. 1, in a fully assembled state and placed in a printer for use, according to an aspect.

FIG. 5 illustrates a top-perspective view of the platen 500 from FIG. 1, fully assembled and placed in a printer 550 for use, according to an aspect. The thermostat controller 515 is visible in this view. The vacuum fans (not shown) on the direct heat vacuum platen 500 are intentionally oriented toward the printer 550 in the herein disclosed example configuration of FIG. 5. During operation, the vacuum fans may be oriented such that their exhaust is directed away from a device operator, the print head, and the print substrate. This potential orientation may be implemented for a variety of reasons. One reason is that it may be unpleasant or unsafe for an operator to be exposed to the heated air, as well as potential ink or toner fumes propelled out of the vacuum fans. Another reason is that the exhaust fans may create air currents that affect print quality, as well as cause the print head to dry faster, causing it to require maintenance more frequently. Additionally, the vacuum fans require clearance space in order to operate properly, which may be blocked by an operator if they come too close to the vacuum fans. The clearance provided by the space within the printer assembly allows for sufficient room to be provided to the vacuum fans to allow for their proper operation.

The utilization of vacuum fans as a method of creating suction to hold the print substrate in a fixed location provides a variety of unique benefits. The inclusion of the vacuum fans on the disclosed platen 500 itself removes the need for an external vacuum device, such as a vacuum pump, as well as any intermediary connections, such as a hose between the vacuum pump and the platen. This reduction of external components helps to reduce device complexity, weight, and cumbersomeness, as well as increase ease of use. The vacuum fans also may require less power to operate than many conventional vacuum pumps. For example, both disclosed vacuum fans on the direct heat vacuum platen 500 may together require less than half an amp of current at the provided 120 volts (less than 60 watts) to successfully secure the print substrate in place, while a vacuum pump may need 5 to 8 amps at 120 volts (600 to 960 watts) to operate. The vacuum fans may be powered by the same external power source as the thermostat controller, reducing the number of external outlets required to power the disclosed platen 500. Additionally, the usage of vacuum fans may provide a quiet method of attaining the print substrate immobilization needed. Within a specific application, each vacuum fan may be about 1 inch long, about 3.14 inches wide and about 3 inches high, with a rated voltage between 90 volts and 270 volts and a power of 2 watts. During operation, the disclosed fans may reach speeds between 2,520 RPM and 3080 RPM, resulting in an air flow between 39.2 CFM and 48.0 CFM and reaching volumes between 28 and 34 dBA. The vacuum fans may be provided with different specifications depending on the needs of the applications, based upon the print substrate, type of printing, and use of ink, toner, or other print substrate.

Figure 6:
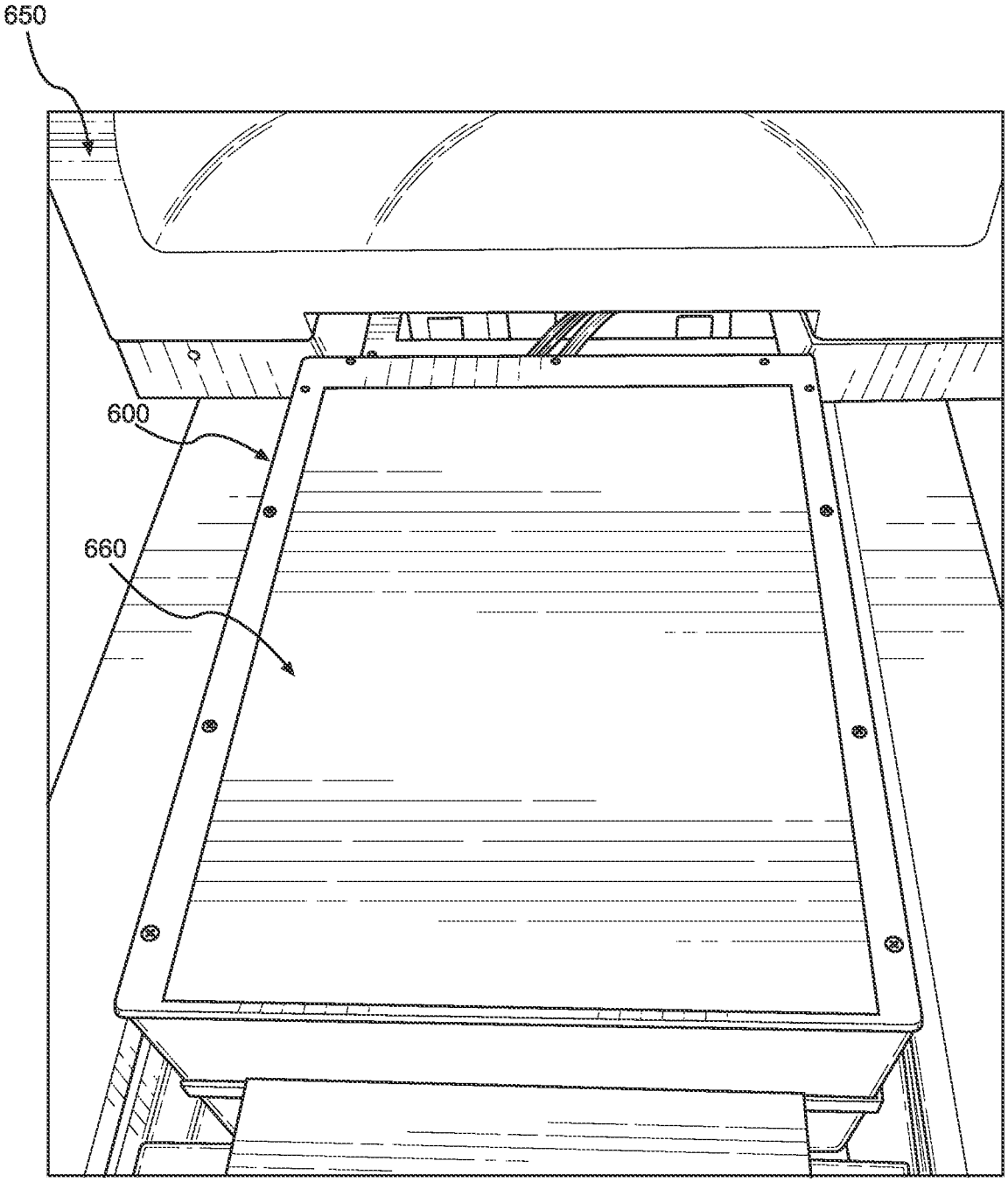
FIG. 6 illustrates another top-perspective view of the platen from FIG. 1, fully assembled and placed in a printer for use, and having a sheet ready for print on top, according to an aspect.

FIG. 6 illustrates another top-perspective view of the platen 600 from FIG. 1, in a fully assembled state and placed in a printer 650 for use and having a sheet 660 ready for print on top, according to an aspect. The sheet 660 provided may be A3 sized, having dimensions of 11.7 inches by 16.5 inches. The herein disclosed direct temperature vacuum platen 600 may be provided in various sizes, such as being 13.25 inches wide, 18 inches long and 3.79 inches high, in order to properly accommodate a standard A3 size print substrate. The resultant weight of said platen may be about 10.41 lbs. The suction ports on the main top may be configured to immobilize a standard A3 sheet print substrate by each applying a vacuum force from within the platen cavity to a different portion of the held sheet. These portions include parts of the perimeter of the A3 sheet, as well as parts of the middle portion running parallel with, and equidistant from longer side edges present on the A3 sheet. The size of the platen 600 may be adapted to both fit in the desired printer 650 and securely hold the desired size of sheet 660 through simple modification of the platen 600 dimensions and suction port arrangement.

As a result of the hereinabove described components of the direct heat vacuum platen 600, the direct heat vacuum platen 600 is capable of simultaneously providing both heat and suction to a print substrate, such as a sheet 660, positioned on the platen 600. This simultaneous heat and suction provided by the direct heat vacuum platen 600 allows for ink, toner or another material to be applied to a print substrate for rapid drying/application, while preventing the print substrate from moving. A desired platen temperature may be set through manipulation of the attached thermostat controller, allowing for the user to achieve the appropriate balance of print speed and print quality. The hereinabove described vacuum fans (not shown) provide a simple, power efficient and quiet method for securing the print substrate in place without the need for external vacuum systems.

Figure 7:
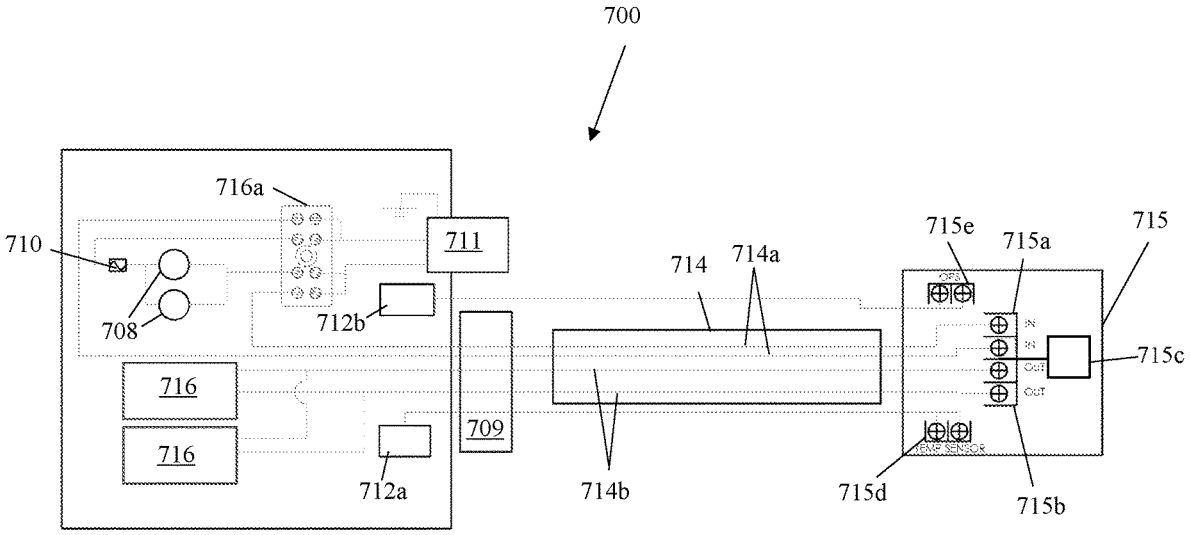
FIG. 7 illustrates an electrical diagram of the platen from FIG. 1, according to an aspect.

FIG. 7 illustrates an electrical diagram of the platen 700 from FIG. 1, according to an aspect. The cord holder 709 is visible in this view. An example of the potential interconnection of each of the electrical elements of the herein disclosed direct heat vacuum platen 700 may be seen within FIG. 7. The power connector 711 may be configured to connect an external power source to the wire terminal block 716*a*, which in turn connects, directly or indirectly, to the various powered elements of the platen 700. The wire terminal block 716*a* may connect to the input portion of the thermostat cord 714*a* and the fan fuse holder 710. Fan fuse holder 710 may connect to the vacuum fans 708 in parallel, to allow said vacuum fans 708 to be powered to provide the required suction during device operation. The input portion of the thermostat cord 714*a* may connect to an input portion of the thermostat controller 715*a*, the input portion of the thermostat controller 715*a* may connect to an output portion of the thermostat controller 715*b* using the aforementioned thermostat power switch 715*c*, and the output portion of the thermostat controller 715*b* may then connect to the output portion of the thermostat cord 714*b*. The output portion of the thermostat cord 714*b* may then connect to the heat element caps 716 and then the heat element plates (not shown), in order to power the heating elements to provide the required heating during platen 700 operation. Two temperature sensors may also be connected to the thermostat controller 715, either through being attached to the thermostat cord 714, as described previously, or being separate from the thermostat cord assembly, as seen in FIG. 7. One temperature sensor may act as a standard temperature sensor 712*a* and be used for monitoring the platen temperature, connecting directly to a temperature sensor port 715*d* on the thermostat controller 715, while the other temperature sensor may act as an overheat protection sensor 712*b*, or OPS, connecting to an OPS port 715*e* on the thermostat controller 715. The OPS 712*b* may halt platen operation if it detects a temperature above an established temperature safety limit. Variations on the disclosed platen 700, such as including different amounts of vacuum fans 708, fuse holders, heating elements, wire terminal blocks 716*a* and temperature sensors, as well as varying the locations of platen elements, may necessitate logical alterations to the described electrical system.

The thermostat power switch 715*c* may provide power to the heat element caps 716, and thus the attached heat element plates, when the standard temperature sensor 712*a* detects a temperature below a certain minimum temperature threshold and cut off power flow to the heat elements caps 716 and heat element plates when the standard temperature sensor 712*a* detects a temperature above a certain temperature threshold. The overheat protection sensor 712*b* may prevent overheating of the platen 700 by cutting off power to the heat element caps 716 and heat element plates if the overheat protection sensor 712*b* detects a temperature above the temperature safety limit. This turning on and off the power sent to the heat elements may be done automatically by the thermostat power switch 715*c*, without the need for a user to manipulate said thermostat controller beyond setting the desired temperature range. The thermostat power switch 715*c* may be disposed between the input portion of the thermostat controller 715*a* and the output portion of the thermostat controller 715*b*, such that said thermostat power switch 715*c* may selectively distribute power to the heat elements based upon the current platen temperature read by the standard temperature sensor 712*a* and the overheat protection sensor 712*b*.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A direct heat vacuum platen device, comprising:

a main case having:

a case body having a solid bottom portion, an open top portion, a pair of opposite long side ends, a short back end and a short front end, the short front end having two fan ports, a cord port, a power connector port and a fuse port;

a support wall attached to the solid bottom portion and disposed between the opposite side long ends;

a sensor mount attached to the solid bottom portion and disposed between the opposite side long ends;

two vacuum fans, one vacuum fan attached to each fan port;

a print surface comprising:

a main top having a top surface, a bottom surface, a pair of opposite long side portions, a short back portion and a short front portion, a set of three columns of suction ports positioned on each opposite long side portion, one central column of suction ports disposed equidistantly between the two sets of three columns of suction ports, two rows of suction ports positioned on the short back portion and disposed between the two sets of three columns of suction ports, one row of suction ports positioned on the short front portion and disposed between the two sets of three columns of suction ports, wherein the main top is configured to securely attach over the open top portion of the main case to form a platen cavity and wherein an outer perimeter of suction ports defines a rectangular area;

a heat transfer panel secured below the main top, the heat transfer panel having two holes and a column of panel suction ports, each suction port of the column of panel suction ports configured to align coaxially with a suction port of the central column of suction ports on the main top and wherein the heat transfer panel is configured to not cover any suction ports;

two heat element plates secured below the heat transfer panel, the two heat element plates running parallel with each other and being separated from each other by a fixed gap, each heat element plate having an attached wire terminal block and heat element cap, wherein each heat element cap is configured to fit within one of the two holes on the heat transfer panel, such that the fixed gap between the two heat element plates is maintained and the column of panel suction ports is positioned above the fixed gap and wherein the heat element plates are configured to not cover any suction ports;

three heat element brackets configured to attach to the main top by its bottom surface such that the heat transfer panel and heat element plates are secured between the heat element brackets and the main top with the two heat element plates below the heat transfer panel;

a thermoregulator having:

a thermostat controller;

a thermostat cord attached to the thermostat controller and each heat element cap;

a cord holder attached to the thermostat cord and attached to the short front end of the main case such that the thermostat cord travels through the cord holder and the cord port in the short front end of the main case;

two temperature sensors, each temperature sensor being attached to the sensor mount and the thermostat cord;

a thermostat power switch connected to the thermostat controller wherein the thermostat power switch is configured to selectively provide power to the heat element plates based upon a platen temperature detected by the temperature sensors; and a power controller having:

a power connector attached to the power connector port, the power connector comprising a power slot configured to connect to an external power source, a main fuse holder attached to the power slot and a power switch attached to the power slot wherein the power switch is configured to selectively engage or disengage power draw from the external power source and electrical wiring configured to connect the power connector to the wire terminal blocks, the wire terminal blocks to a fan fuse holder and thermostat cord, the thermostat cord to the heat element caps and the fan fuse holder to the vacuum fans, wherein the fan fuse holder is attached to the fuse port.

2. The direct heat vacuum platen device of claim 1, wherein the rectangular area is configured to fit within an area formed by a standard A3 sized print substrate.

3. The direct heat vacuum platen device of claim 2, wherein the print substrate is a film.

4. The direct heat vacuum platen device of claim 1, further comprising a top gasket positioned between the main top and the main case, a fuse gasket positioned between the fan fuse holder and the main case, a power connector gasket positioned between the power connector and the main case, and a fan gasket positioned between each vacuum fan and the main case, wherein the top gasket, a cord gasket, power connector gasket and each fan gasket are configured to further seal the platen cavity.

5. The direct heat vacuum platen device of claim 4, wherein the top gasket, fuse gasket, power connector gasket and each fan gasket are made of silicone.

6. The direct heat vacuum platen device of claim 1, further comprising a plurality of anti-slip pads configured to attach to the direct heat vacuum platen device, wherein the anti-slip pads are configured to prevent movement of the direct heat vacuum platen device during printing.

7. The direct heat vacuum platen device of claim 1, wherein the external power source provides 120 volts AC.

8. The direct heat vacuum platen device of claim 1, wherein each vacuum fan operates at a speed between 2,520 RPM and 3080 RPM, resulting in an air flow rate between 39.2 CFM and 48.0 CFM through each vacuum fan, reaching sound levels between 28 and 34 dBA.

9. The direct heat vacuum platen device of claim 1, wherein one temperature sensor is positioned about 7.4321 inches from the short front end of the main case and about 5.779 inches from one of the opposite long side ends of the main case and the other temperature sensor is positioned about 7.4321 inches from the short front end of the main case and about 5.2674 inches from the other opposite long side end of the main case.

10. A direct heat vacuum platen device, comprising:

a main case having:

a case body having a solid bottom portion, an open top portion, a pair of opposite long side ends, a short back end and a short front end, the short front end having two fan ports;

a sensor mount attached to the solid bottom portion and disposed between the opposite side long ends;

two vacuum fans, one vacuum fan attached to each fan port;

a print surface comprising:

a main top having a top surface, a bottom surface, a pair of opposite long side portions, a short back portion and a short front portion, a set of three columns of suction ports positioned on each opposite long side portion, one central column of suction ports disposed equidistantly between the two sets of three columns of suction ports, two rows of suction ports positioned on the short back portion and disposed between the two sets of three columns of suction ports, one row of suction ports positioned on the short front portion and disposed between the two sets of three columns of suction ports, wherein the main top is configured to securely attach over the open top portion of the main case to form a platen cavity and wherein an outer perimeter of suction ports defines a rectangular area;

two heat element plates secured below the main top, the two heat element plates running parallel with each other and being separated from each other by a fixed gap, each heat element plate having an attached wire terminal block and heat element cap, wherein the central column of suction ports on the main top is positioned above the fixed gap and wherein the heat element plates are configured to not cover any suction ports;

a thermoregulator having:

a thermostat controller;

a thermostat cord attached to the thermostat controller and both heat element caps wherein the thermostat cord travels into the main case through a cord port;

two temperature sensors, each temperature sensor attached to the sensor mount and the thermostat controller;

a power controller having:

a power slot configured to connect to an external power source;

a power switch attached to the power slot, the power switch configured to selectively engage or disengage power draw from the external power source and electrical wiring configured to provide power to the thermostat controller, heat element caps and vacuum fans.

11. The direct heat vacuum platen device of claim 10, wherein one of the temperature sensors is configured to be used for temperature monitoring and moderation and the other temperature sensor is configured to be used for overheating protection.

12. The direct heat vacuum platen device of claim 10, wherein the thermostat controller is configured to shut off power to the platen if one of the temperature sensors registers a temperature that exceeds a temperature safety limit.

13. The direct heat vacuum platen device of claim 10, wherein the thermostat controller is configured to set the printing surface to a desired temperature.

14. The direct heat vacuum platen device of claim 13, wherein printing at the desired temperature provides a desired balance of print speed and print quality.

15. A direct heat vacuum platen device, comprising:

a main case having a case body with a fan port;

a vacuum fan attached to the fan port;

a print surface comprising:

a main top attached to the case body to form a platen cavity, wherein operation of the vacuum fan creates a vacuum within the platen cavity;

a plurality of suction ports in the main top arranged in a pattern consistent with a perimeter of a desired print substrate, wherein the vacuum within the platen cavity creates a suction effect at the main top through the plurality of suction ports;

a heater attached to the main top, wherein the heater is configured to provide heat to the main top while not covering any suction ports; and wherein the heater is comprised of two heat element plates configured to attach to the main top, each heat element plate configured to attach to a heat element cap and a wire terminal box, wherein the wire terminal box is configured to connect to a thermostat cord;

a thermoregulator having a thermostat controller connected to a temperature sensor and the heater, wherein the thermostat controller is configured to monitor and manipulate a temperature on the direct heat vacuum platen; and a power controller attached to the main case configured to connect an external power source to the thermostat controller and vacuum fan, wherein the direct heat vacuum platen is configured to simultaneously provide suction and heat to a desired print substrate positioned on the printing surface.

16. The direct heat vacuum platen device of claim 15, wherein the heater uses a resistance-based heating method to provide heat to the print surface.

17. The direct heat vacuum platen device of claim 15, wherein the heater is further comprised of a heat transfer panel positioned between the heat element plates and the main top, wherein the heat transfer panel has a plurality of panel suction ports, each suction port of the plurality of panel suction ports configured to align coaxially with a suction port of the plurality of suction ports on the main top and wherein the heat transfer panel is configured to not cover any suction ports.

18. The direct heat vacuum platen device of claim 17, wherein the heat transfer panel comprises two holes, wherein each hole is configured to fit around a heat element cap from each heat element plate such that the heat element plates run parallel to each other and are separated from each other by a fixed gap.

19. The direct heat vacuum platen device of claim 15, further comprising a column of suction ports in the main top that bisects the pattern formed by the plurality of suction ports in the main top and a column of suction ports in the heater, wherein each suction port of the column of suction ports in the heater aligns coaxially with a suction port of the column of suction ports in the main top.

* * * * *